US010485314B2

(12) United States Patent
Teran

(10) Patent No.: US 10,485,314 B2
(45) Date of Patent: Nov. 26, 2019

(54) ACCESSORY CADDY FOR LUGGAGE

(71) Applicant: Steve Teran, Monument, CO (US)

(72) Inventor: Steve Teran, Monument, CO (US)

( * ) Notice: Subject to any disclaimer, the term of this patent is extended or adjusted under 35 U.S.C. 154(b) by 55 days.

(21) Appl. No.: 15/401,685

(22) Filed: Jan. 9, 2017

(65) Prior Publication Data

US 2018/0192754 A1 Jul. 12, 2018

(51) Int. Cl.

| | |
|---|---|
| ***A45C 5/03*** | (2006.01) |
| ***A45C 13/00*** | (2006.01) |
| ***A45C 5/06*** | (2006.01) |
| ***A45C 5/14*** | (2006.01) |
| *A45C 13/26* | (2006.01) |

(52) U.S. Cl.

CPC ..... *A45C 13/002* (2013.01); *A45C 5/03* (2013.01); *A45C 5/06* (2013.01); *A45C 5/14* (2013.01); *A45C 13/262* (2013.01); *A45C 2005/037* (2013.01)

(58) Field of Classification Search

CPC ..... A45C 13/002; A45C 5/141; A45C 5/03

USPC ..... 190/100–113, 26; 150/154, 159, 150/165–166; D3/321, 318

See application file for complete search history.

(56) References Cited

U.S. PATENT DOCUMENTS

| | | | | |
|---|---|---|---|---|
| 2,647,595 | A * | 8/1953 | Meyers | A45C 13/002 190/26 |
| 2,711,234 | A * | 6/1955 | Rubens | A45C 13/002 190/26 |
| 6,698,771 | B1 | 3/2004 | Bergeron | |
| 7,077,251 | B1 * | 7/2006 | Gaither | A45C 13/002 150/105 |
| 7,093,699 | B2 | 8/2006 | Yu | |
| 7,458,452 | B2 * | 12/2008 | Beakey | A45C 13/002 150/105 |
| 7,987,552 | B2 | 8/2011 | Gordon | |
| D660,000 | S * | 5/2012 | Peterson | D3/318 |
| D667,635 | S * | 9/2012 | Sanchez | D3/318 |
| 8,267,230 | B2 * | 9/2012 | Johnson | A45C 13/002 150/105 |
| D680,332 | S * | 4/2013 | Webster | D3/318 |
| D696,516 | S * | 12/2013 | Caspi | D3/318 |
| 9,101,199 | B1 * | 8/2015 | Harry | A45F 4/02 |
| 2007/0017764 | A1 * | 1/2007 | Cheng | A45C 13/002 190/100 |
| 2010/0270115 | A1 * | 10/2010 | Seamon | A45C 13/002 190/26 |
| 2012/0199594 | A1 * | 8/2012 | Pernarella | A45C 13/002 220/694 |
| 2016/0066669 | A1 | 3/2016 | Lien | |

* cited by examiner

*Primary Examiner* — Sue A Weaver
(74) *Attorney, Agent, or Firm* — Hanes & Bartels LLC

(57) ABSTRACT

An accessory caddy comprising a pliant covering including interconnected front, back and side panels and a top member interconnected with the front, back and side panels and having a top surface, an elongated aperture and a mutually parallel elongated handle fixed to the top surface and a spring biased pivotal spreader bar attached to each of the side panels.

4 Claims, 3 Drawing Sheets

ACCESSORY CADDY FOR LUGGAGE

The present invention pertains to a pliant foldable carrier for the type of accessories a passenger would carry onto an aircraft which doubles as a luggage cover.

BACKGROUND

The general concept of simplifying the performance of a specific activity by providing a caddy for carrying the necessary tools and accessories that relate to the task is well documented in the prior art See, for example, U.S. Pat. No. 6,698,771 for a wheeled caddy and U.S. Pat. No. 7,987,552 for a floor care appliance with a tool caddy, among others.

The prior art is also replete with luggage covers with various features for protecting either a soft or hard shell piece of luggage. See, for example, U.S. Pat. No. 7,093,699 which discloses a luggage cover that has a panel which is expandable to accommodate and expandable luggage container. Also see U.S. published application No. 20160066669 that discloses a stretchable sleeve-like cover.

While there are multiple disclosures in both of these arts, there has been no combination of the two that is specifically directed to aircraft passengers that want to have carry-on luggage but at the same time want to be able to have access during the flight to various accessories, such as a laptop computer, headphones or a sandwich, without having to wrestle the luggage out of the overhead bin storage to retrieve these items.

It is therefore the primary object of this invention to provide a pliant fabric caddy for carrying the type of accessories a passenger would want to carry aboard an aircraft such as a laptop computer, sound canceling headphones, reading materials and the like which, after removing some or all of the accessories, the caddy can be folded and placed under a seat.

A second object of the invention is to provide a convenient carrier for the caddy in the form of the traditional soft or hard shell carry-on luggage. The caddy is in the form of a sleeve-type cover for the body of the luggage.

In operation, the cover/caddy is placed onto the body of the luggage and loaded with the desired accessories. When aboard the aircraft, the cover/caddy is removed from the luggage which is then stored in the overhead bin for the duration of the flight. At the seat, the passenger unloads ail or some of the accessories and folds the caddy into a shape and size that will fit underneath the seat. The folded caddy is immediately available for retrieval of accessory items left in the caddy without having to obtain the carry-on luggage from the overhead bin.

DETAILED DESCRIPTION OF A PREFERRED FORM OF THE INVENTION

Figure 1:
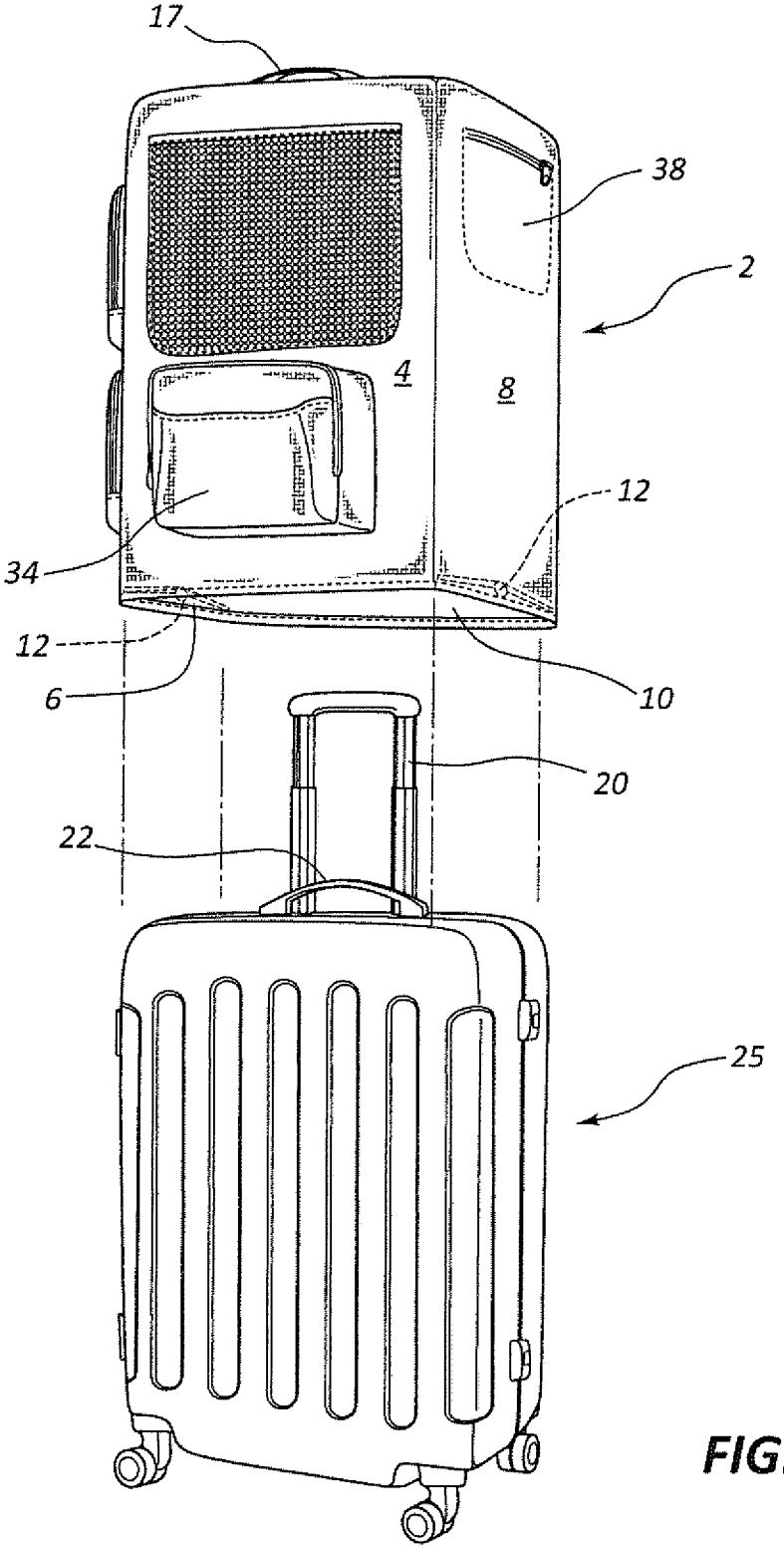
FIG. 1 is a perspective view of a traditional hard-shell carry-on luggage with the caddy of the present invention positioned over the luggage in preparation for being placed onto the luggage as a cover.
Figure 2:
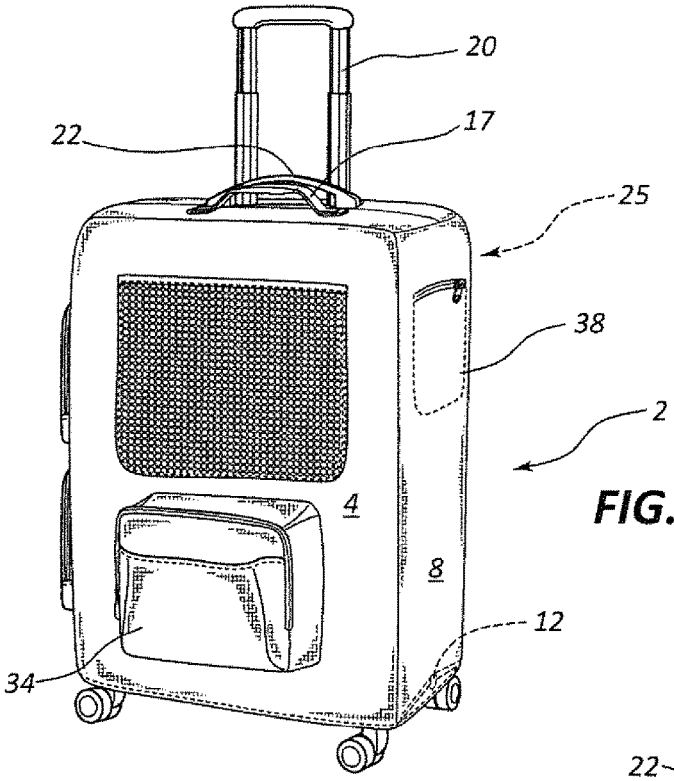
FIG. 2 is a perspective view of the front side of the luggage with the cover/caddy in place.
Figure 3:
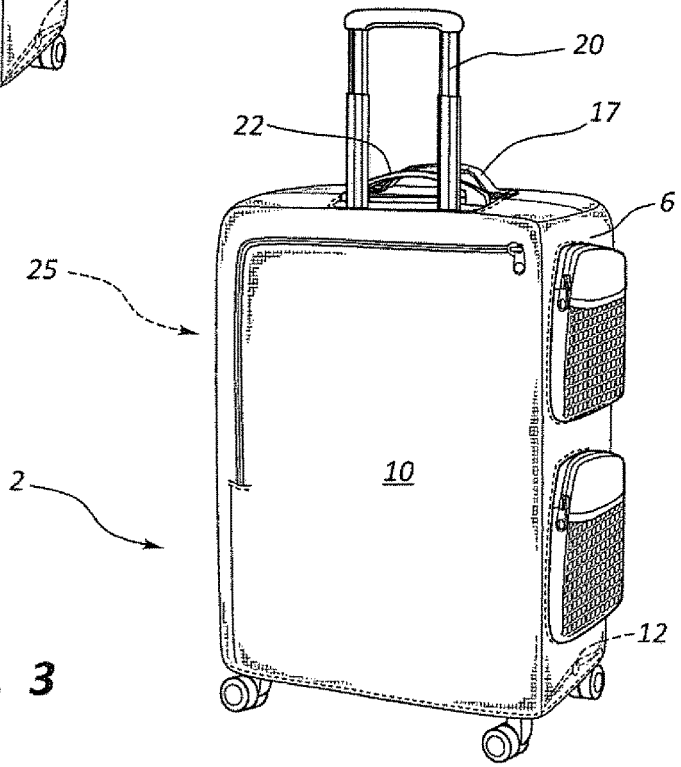
FIG. 3 is a perspective view of the back side of the luggage with the cover/caddy in place.
Figure 4:
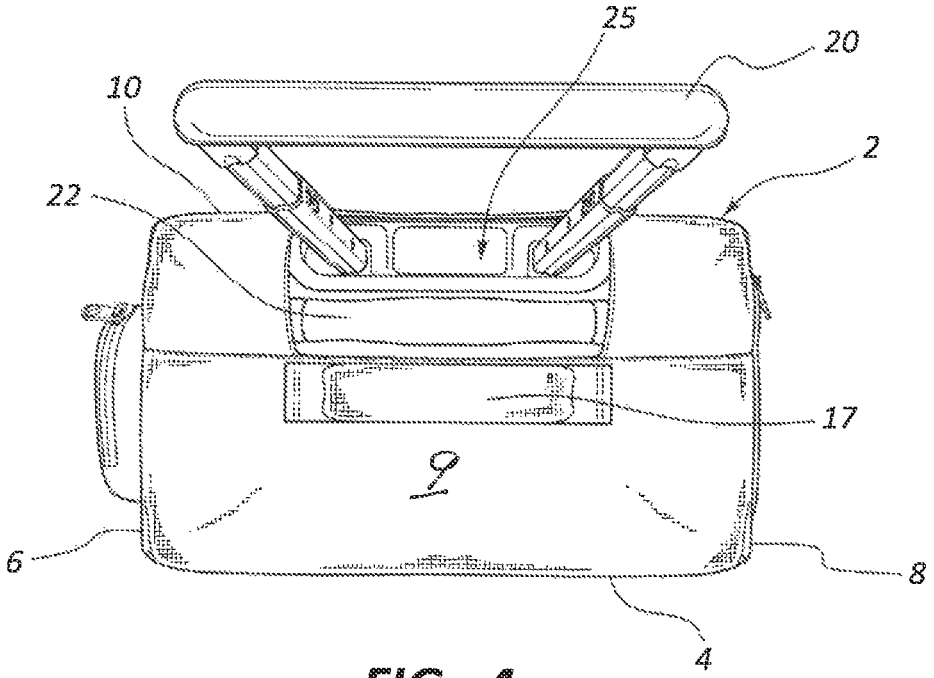
FIG. 4 is a perspective view of the top of the luggage with the cover/caddy in place.

The accessory caddy 2 of the present invention comprises a front panel 4 interconnected to first and second side panels 6 and 8 which are each interconnected to a back panel 10. A rectangular top member 9 is attached along its perimeter to the front, back and side panels. The top member includes a rectangular aperture 15 to accommodate the telescoping handle 20 and a carrying handle 22 of the luggage 25. Proximate the front edge of the aperture 15 is disposed a caddy handle 17 which is centrally located on the top member. That is, the center 49 of the handle 17 is equidistant from the front and back panels and equidistant from the opposing side panels in order to provide a balanced puffing force on the caddy when it is removed from the luggage 25.

Along the inside bottom edge of each side panel there is secured a spring biased spreader bar 12 comprising a pivotal center attachment of the two arms of the spreader bar. The ends of each of the bar halves are attached to the corners formed by the junction of the side panels with the front and back panels. When it is desired to place the cover over the luggage each of the spreader bars is extended to form a straight configuration that maintains spacing between the front and back panels thereby holding the cover in an open shape to facilitate placing the cover over the luggage. When the cover is removed upward pressure on the center pivot point of the spreader will cause the arms of the spreader to comply with the spring pressure and converge into a mutually parallel position, thus collapsing the front and back panels together.

Figure 5:
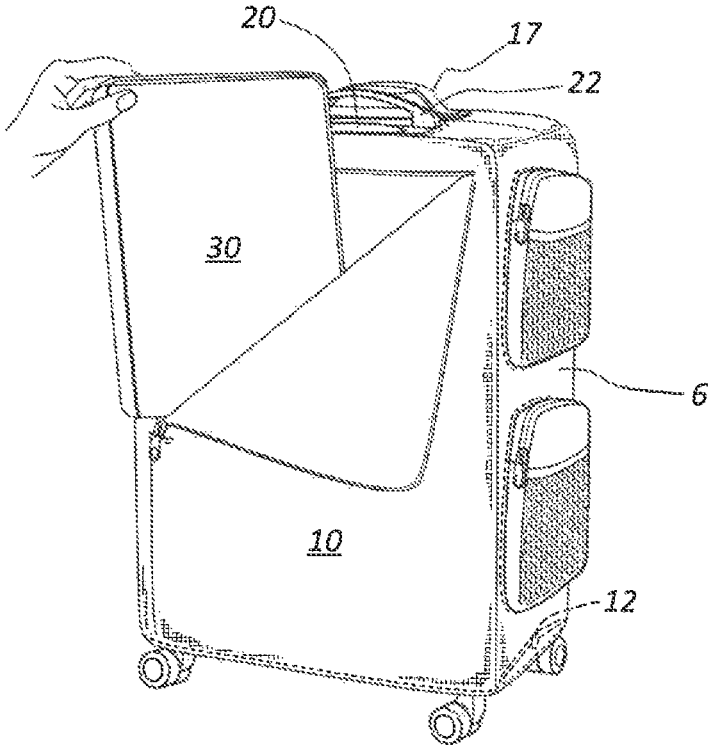
FIG. 5 is a perspective view of the back side of the luggage illustrating the placement of a laptop computer or similar article within one of the pockets of the caddy.

To accomplish its primary purpose the caddy 2 includes a variety of pockets in which desired accessories may be stored. FIG. 5 illustrates convenient pocket for carrying a laptop computer 16 or similar article. The perimeter of a second back panel 11 is sewn or otherwise attached to the perimeter of the back panel 10 forming a pocket space therebetween. The second back panel 11 contains a zippered opening 13 through which entry to the pocket space may be obtained for placement of the desired accessory, such as a laptop computer.

The preferred embodiment includes two accessory pockets on the front panel 4. A see-through pocket 30 includes a rectangular piece of netting or mesh secured to the front panel along is sides and bottom. The top perimeter is not attached to the front panel to provide access to the pocket.

Beneath the pocket 30 on the front panel 4 is a closable compartment 34 that may be sized and dimensioned for carrying sound cancelling headphones.

Mounted on one of the side panels 6 are a pair of closable pouches 36 and 38 that are plastic lined for carrying food stuffs, for example.

The opposing side 8 of the caddy includes a pocket constructed of a layer of fabric 38 attached to the side panel which layer contains a zippered opening 39 for accessing the space between the side panel and the fabric layer.

All of the pockets, which include the compartment and the pouches, may be varied in size, shape and position on the caddy to accommodate a variety of accessories which may be useful to a passenger during a flight on an aircraft, a train trip or on a boat where the luggage may be put away and the accessories obtained from the caddy and used during the trip.

I claim:

1. An accessory caddy, comprising, a pliant covering including, interconnected and spaced apart front, back and side panels, a top member interconnected with the front, back and side panels and having a top surface, an elongated aperture therein and an elongated handle fixed to the top surface in a position parallel to the elongated aperture, and a spreader bar having first and second pivotally interconnected spring biased arms respectively disposed proximate each of the side panels and where the arms are attached to the respective front and back panels.

2. The caddy of claim 1 where the back panel includes a substantially congruent second panel attached to the back panel along their respective perimeters and including a zippered opening in the second panel.

3. The caddy of claim 2 where the front panel includes a rectangular net having sides and a bottom which are each attached to the front panel.

4. An accessory caddy, comprising, a pliant covering including, interconnected and spaced apart front, back and side panels, a top member interconnected with the front, back and side panels and having a top surface, an elongated aperture therein and an elongated handle fixed to the top surface in a position parallel to the elongated aperture, at least one accessory pocket carried by at least one of the front, back and side panels, and a spreader bar having first and second pivotally interconnected spring biased arms respectively disposed proximate each of the side panels and where the arms are attached to the respective front and back panels.

* * * * *